United States Patent [19]

Chung

[11] Patent Number: 4,822,025

[45] Date of Patent: Apr. 18, 1989

[54] DEVICE FOR SORTING COPIED PAPERS

[75] Inventor: Jae Heon Chung, Eujungbu, Rep. of Korea

[73] Assignee: Sindo Ricoh Co., Ltd., Seoul, Rep. of Korea

[21] Appl. No.: 219,906

[22] Filed: Jul. 13, 1988

Related U.S. Application Data

[63] Continuation of Ser. No. 000,828, Jan. 6, 1987, abandoned.

[30] Foreign Application Priority Data

Jul. 28, 1986 [KR] Rep. of Korea ..... 1986-6141

[51] Int. Cl.[4] ..... B65H 39/10

[52] U.S. Cl. ..... 271/296; 271/302; 209/433

[58] Field of Search ..... 271/288, 296, 299, 302, 271/303, 287, 292, 294; 270/58, 45, 18, 12; 209/651-654, 706, 933

[56] References Cited

U.S. PATENT DOCUMENTS

| | | | |
|---|---|---|---|
| 2,649,182 | 8/1953 | Parker | 271/302 |
| 3,957,264 | 5/1976 | Bach et al. | 271/296 |
| 4,265,445 | 5/1981 | Langner | 271/296 |
| 4,322,069 | 3/1982 | Mitchell | 271/296 |
| 4,328,963 | 5/1982 | DuBois et al. . | |
| 4,361,393 | 11/1982 | Noto | 271/287 |
| 4,466,608 | 8/1984 | DuBois et al. . | |
| 4,466,609 | 8/1984 | Lawrence . | |
| 4,478,406 | 10/1984 | DuBois . | |

FOREIGN PATENT DOCUMENTS

| | | | |
|---|---|---|---|
| 3413238 | 4/1984 | Fed. Rep. of Germany . | |
| 148151 | 9/1983 | Japan | 271/287 |

*Primary Examiner*—H. Grant Skaggs
*Attorney, Agent, or Firm*—Michael N. Meller

[57] ABSTRACT

A device for sorting copied papers discharged from a copy machine according to page numbers thereof includes a guide plate pivotably mounted to a casing of the device at its one end adjacent a paper outlet of the copy machine. At the other end of the guide plate, a pair of paper-feeding rollers are disposed. The device also includes a lift motor adapted to pivot the guide plate in a stepwise manner via a pulley and a wire. Adjacent the guide plate, a plurality of trays are fixedly disposed.

2 Claims, 5 Drawing Sheets

DEVICE FOR SORTING COPIED PAPERS

This application is a continuation of application Ser. No. 000,828, filed 1/6/87, now abandoned.

BACKGROUND OF THE INVENTION

1. Technical Field

The present invention relates to a device adapted as a subsystem of a copy machine, to sort copied papers according to their page numbers, and particularly to a device for sorting copied papers wherein copied papers are sorted and stacked one by one or several by several upon a plurality of trays.

2. Prior Art

Conventional device for sorting copied papers is, for example, shown in FIG. 8. In the device shown in FIG. 8, when a copied paper enters the space between an upper guide plate 30 and a lower guide plate 31, upper and lower rollers 34 and 35 drive to stack said paper upon a tray 32. At this time, a Geneva wheel 33 rotates and engages protrusions 36 formed on both ends of the tray to move said tray upwardly or downwardly so that said tray can be spaced from an adjacent tray a certain distance, for example, 3 to 5 times a normal distance between adjacent trays.

In such a conventional device, the tray has a complex construction, thereby causing the manufacture thereof to be troublesome. In particular, the Geneva wheel adapted to move the tray upwardly and downwardly requires the use of a number of accessories, thereby causing the device to be expensive. Furthermore, noise is generated during the upward and downward movement of the tray.

SUMMARY OF THE INVENTION

Therefore, an object of the present invention is to overcome disadvantages encountered in the above prior art to provide a device for sorting copied papers wherein upward and downward movement of the guide plate for sorting papers is accurately controlled by means of a lift motor and a wire so that a copied paper can be surely stacked upon a predetermined one of the fixed trays which are uniformly spaced from one another.

Another object of the present invention is to provide a device for sorting copied papers wherein a Geneva wheel is eliminated, enabling the use of other accessories to be eliminated and the number of parts to be reduced.

Another object of the present invention is to provide a device for sorting copied paper wherein trays are constructed in a fixed type to prevent the generation of noise.

In accordance with the present invention, these objects can be accomplished by providing a device for sorting copied papers discharged from a copy machine according to page numbers thereof, comprising: a casing having an attachment adapted to removably attach the device to the paper outlet of said copy machine; a guide plate pivotably mounted to said casing at its one end adjacent said paper outlet of the copy machine; a paper-feed roller mounted to the other end of said guide plate and driven by a feed motor via a belt; a second paper-feed roller disposed to contact with and follow said first paper-feed roller; a lift motor adapted to pivot said guide plate step by step via a pulley fixed to a shaft of said lift motor and a wire fixed at its one end to said guide plate and its other end to said pulley; and a plurality of trays each provided at one end adjacent said guide plate with a stacker for arranging copied papers and at the other end with a rib adapted to adjust a space between adjacent trays.

BRIEF DESCRIPTION OF THE DRAWINGS

The present invention will further be described hereinafter with reference to the accompanying drawings wherein.

DETAILED DESCRIPTION OF THE PREFERRED EMBODIMENTS

Figure 1:
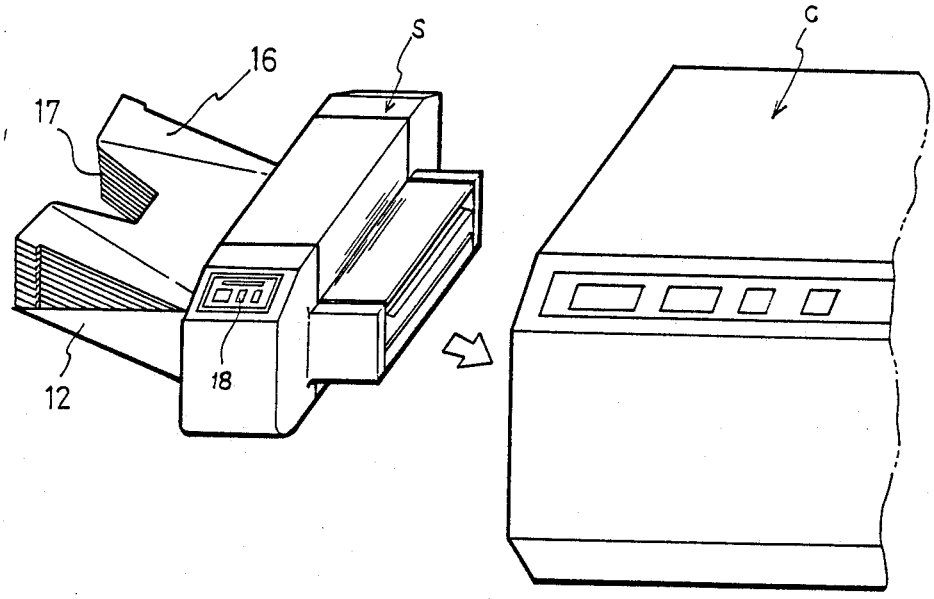
FIG. 1 is a perspective view of a device in accordance with the present invention.
Figure 2:
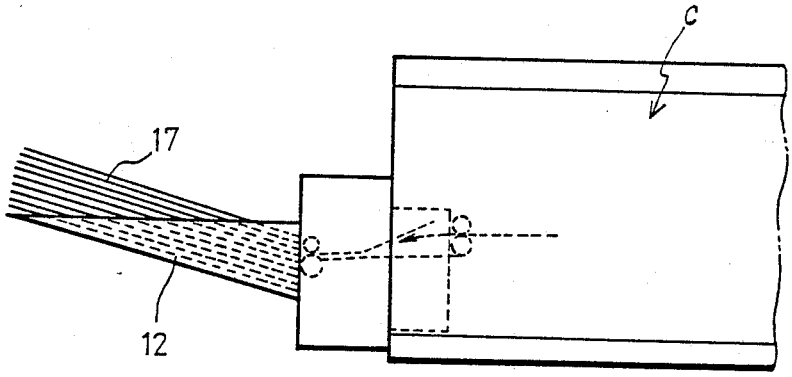
FIG. 2 is a schematic side view showing the condition when a device of the present invention is attached to a copy machine.
Figure 3:
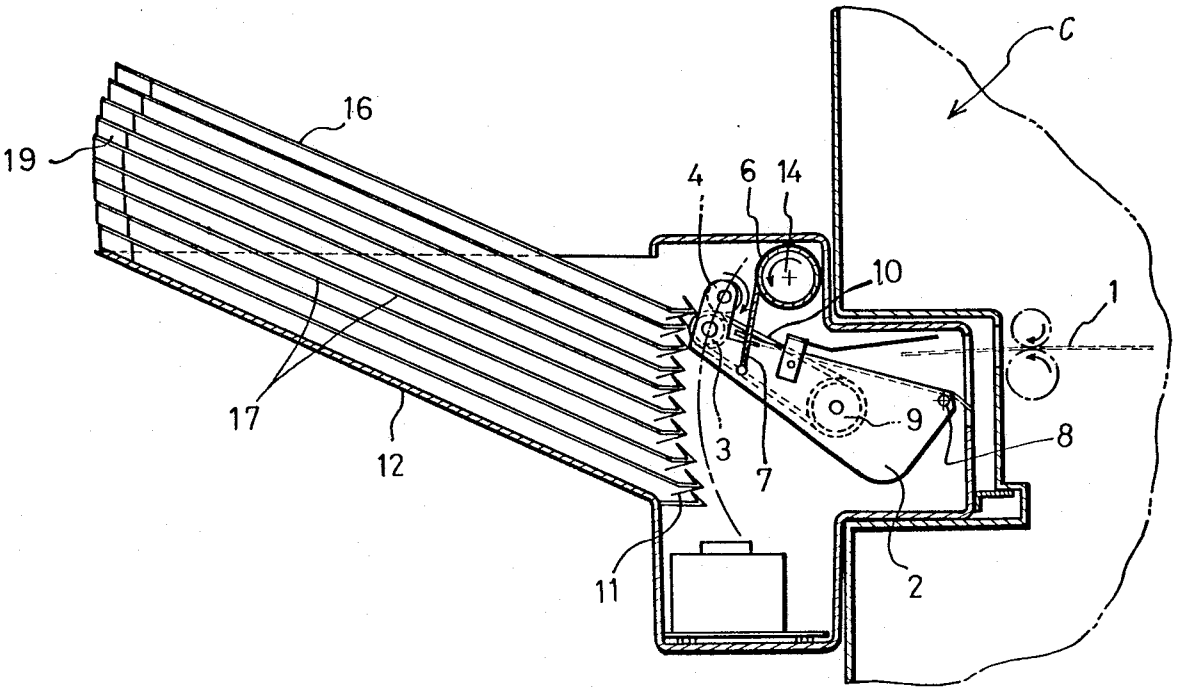
FIG. 3 is a sectional view of a device of the present invention.

FIGS. 1 and 3 show a device for sorting copied papers 1 discharged from a copy machine C according to page numbers. As shown in FIG. 3, the device of the present invention comprises a casing having an attachment adapted to removably attach the device to the paper outlet of the copy machine C. Within the casing of the paper-sorting device, a guide plate 2 is disposed to pivot, at its one end adjacent the paper outlet of the copy machine C, about pin 8 fixed to the casing. A pair of paper-feeding rollers 3 and 4 are rotatably mounted to the other end of said guide plate 2. The paper-feeding roller 3 is driven by a feed motor 9 via a belt 10 disposed between said roller 3 and said feed motor 9. The second paper feeding roller 4 is disposed just above the first roller 3 to contact with and follow said first roller. Above the guide plate 2, a lift motor 6 is disposed to control in a stepwise manner the upward and downward pivotal movement of said guide plate 2 via a pulley 14 fixed to a shaft (not shown) of said lift motor 6 and a wire 7 fixed at its one end to said guide plate 2 and at its other end to said pulley 14. In a preferred embodiment of the present invention, the lift motor 6 is a reversible step motor.

Adjacent the other end of the guide plate 2, a plurality of trays 17 are disposed. Uppermost and bottom trays are designated by reference numerals 16 and 12, respectively. Each tray 17 is provided at its one end adjacent said guide plate with a stacker 11 for arranging copied papers incoming into the tray and at its other end with a rib 19 adapted to adjust a space between adjacent trays.

Figure 4:
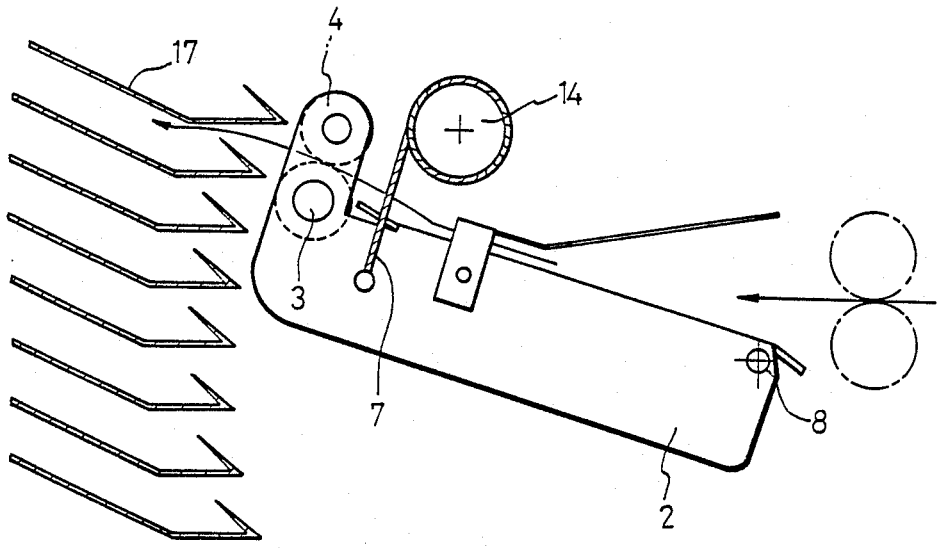
FIG. 4 is a partially enlarged view of a device of the present invention, showing a paper-feeding condition when a guide plate is at its uppermost position.
Figure 5:
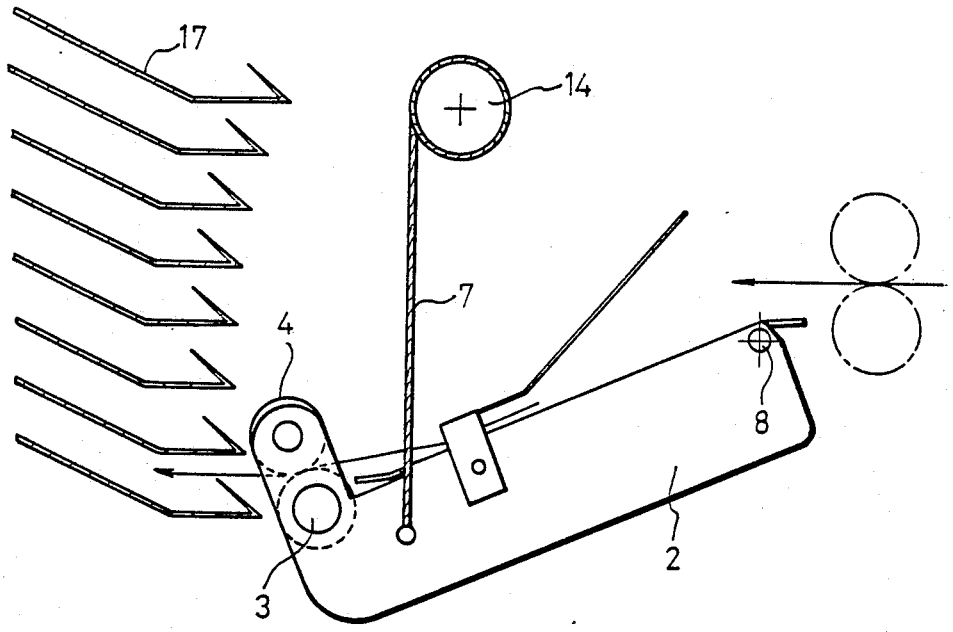
FIG. 5 is a partially enlarged view similar to FIG. 4, but showing a paper-feeding condition when a guide plate is at lowermost position.

Now, the operation of the paper-sorting device in accordance with the present invention will be described in detail, with reference to FIGS. 4 to 6.

As shown in FIG. 3, a copied paper 1 discharging from the outlet of the copy machine C is passed through the guide plate 2 and then stacked upon a predetermined tray 17 by upper and lower paper-feeding rollers 3 and 4 driven by the feed motor 9. In detail, the guide plate 2 is always disposed at its uppermost position by the function of the lift motor 6 whenever paper-sorting button 18 (FIG. 1) is just pushed to the "ON" state to begin sorting. At this time, the copied paper 1 will be stacked upon the uppermost tray 16. Thereafter, the lift motor 6 drives to unwind the wire 7 out of the pulley 14, so that the nip portion between upper and lower paperfeeding rollers 3 and 4 is shifted to a predetermined position, in order to permit a next copied paper to be stacked upon a tray corresponding to said predetermined position.

As discharged from the outlet of the copy machine C, the next copied paper causes a sensor (not shown) to be in an "ON" state and thus to generate a signal for driving the feed motor 9. By the drive of the feed motor 9, paper-feeding rollers 3 and 4 rotate via a belt 10 so that the paper can be stacked upon the tray 17.

In the case when copied papers are required to be sorted several by several, the lift motor 6 maintains its stop condition until predetermined numbers of copied papers are stacked upon the tray. In response to the completion of stacking the predetermined numbers of copied papers upon the tray, the lift motor 6 drives again to shift the nip portion between rollers 3 and 4 to a position corresponding to the next tray. Then the above-mentioned operations are repeated. In this case, each stacker 11 functions to arrange the copied papers so that papers can be stacked in order.

Figure 6:
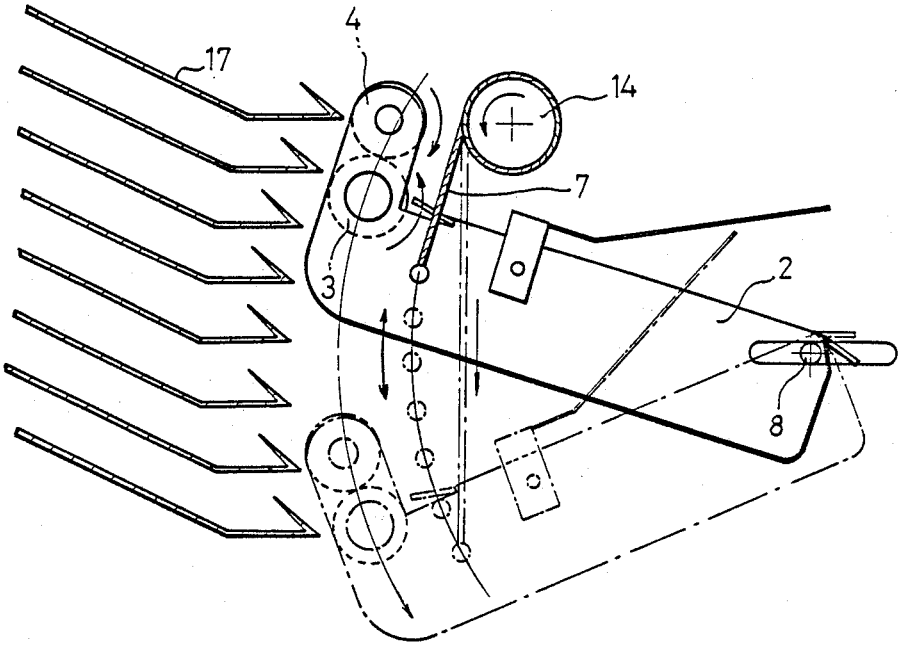
FIG. 6 is a partially enlarged view similar to FIG. 4, but showing the upwardly and downwardly pivoting movement of the guide plate.

As shown in FIG. 6, the guide plate 2 is downward moved from its uppermost position to its lowermost position, as the lift motor 6 rotates in a counter-clockwise direction. As the lift motor 6 rotates in a clockwise direction, on the other hand, the guide plate 2 is upwardly moved from its lowermost position to its uppermost position.

The space between adjacent trays 17 can be automatically adjusted by a rib 19 attached to the other end of each tray.

Figure 7:
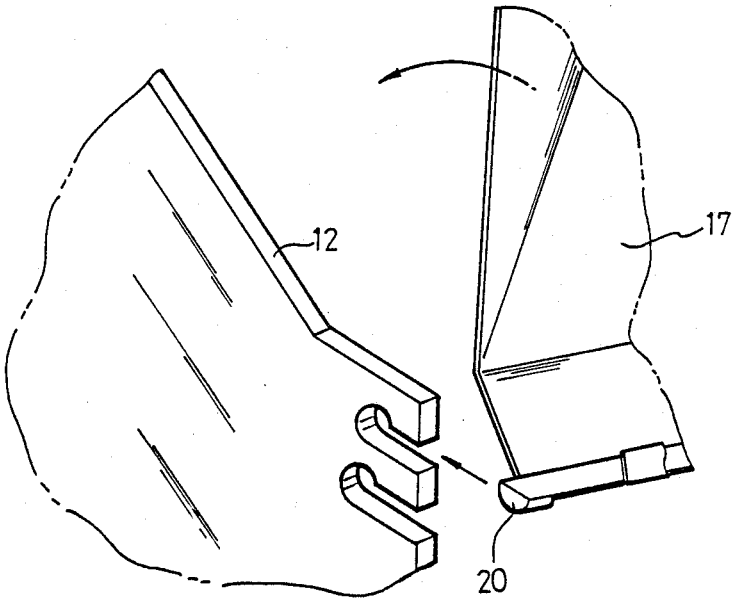
FIG. 7 is a partial perspective view showing connections between a bottom tray and a tray.
Figure 8:
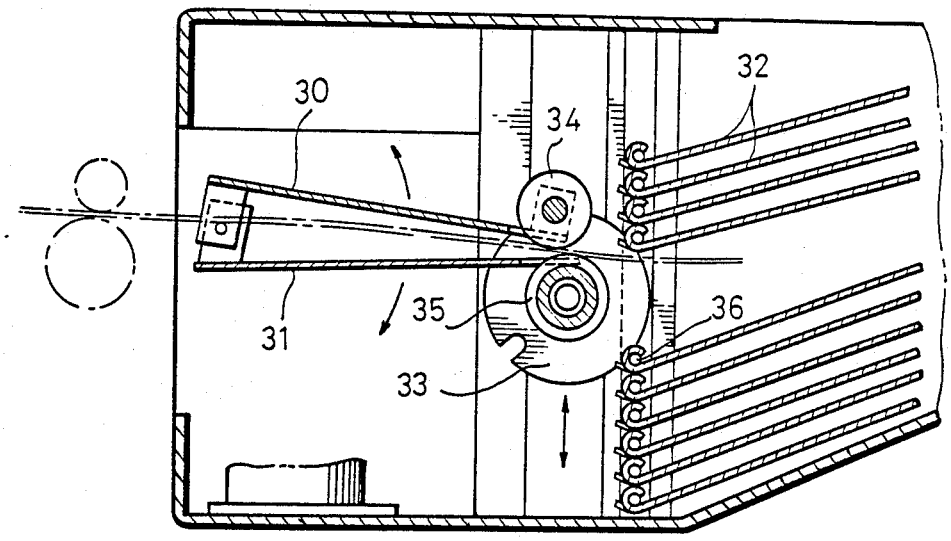
FIG. 8 PRIOR ART
FIG. 8 is a sectional view of a conventional device.

In accordance with the present invention, each tray is constructed in a fixed type to prevent the generation of noise. As shonw in FIG. 7, each tray has at each side wall thereof a semicircular shaft 20 protruded from said side wall and adapted to be rotatably inserted into a slot formed at each side wall of the bottom tray 12, so that each tray can pivot at said shaft thereof with respect to the bottom tray 12. When a misfeed of copied papers into a tray is generated, accordingly, the removal of the tray can be easily carried out.

As is apparent from the above description, the guide plate 2 is pivotably moved with respect to fixed trays so that each copied paper can be accurately disposed at the space between adjacent trays and thus accurately stacked upon the required tray.

The device of the present invention can be attached to various currently available copy machines by means of brackets or magnets. Since the device of the present invention utilizes a wire-winding mode using a motor and a fixed type of trays, the number of parts and the amount of noise can be reduced, as compared with the prior art. In particular, the device of the present invention can be easily and cheaply manufactured in that trays are a fixed type and the Geneva wheel is eliminated.

What is claimed is:

1. A device for sorting copied papers discharged from a copy machine according to page numbers thereof comprising:

a casing having an attachment adapted to removably attach the device to the paper outlet of said copy machine;

a guide plate pivotably mounted on a pivot pin fixed to said casing at its one end adjacent said paper outlet of the copy machine;

a feed motor mounted on said pivotably mounted guide plate;

a first paper-feed roller mounted on the other end of said pivotably mounted guide plate and driven by said feed motor via a belt, said first paper-feed roller being located at a distance from said pivot pin which is greater than the distance from said pivot pin at which said feed motor is located;

a second paper-feed roller disposed to contact with and follow said first paper-feed roller;

a lift motor adapted to pivot said guide plate in a stepwise manner via a pulley fixed to a shaft of said lift motor and a wire fixed at its one end to said guide plate and its other end to said pulley; and a plurality of trays each provided at its one end adjacent said guide plate with a stacker for arranging copied papers and at its other end with a rib adapted to adjust a space between adjacent trays, wherein during pivoting of said guide plate, said feed motor and said paper-feed rollers rotate along respective arcs relative to said pivot pin.

2. A device in accordance with claim 1, wherein said lift motor is a reversible step motor.

* * * * *